US005707553A

United States Patent [19]

Sawyer et al.

[11] Patent Number: 5,707,553

[45] Date of Patent: Jan. 13, 1998

[54] ANTI-CORROSION, QUICK DRYING DISTILLED WATER SOLUTION FOR AUTOCLAVE STERILIZERS

[76] Inventors: Melvyn Lloyd Sawyer, 321-650 West 41st Avenue, Vancouver, British Columbia, Canada, V5Z 2M9; Lennart Goof, Gl. Strandveg 236 A, 3050 Humlebaek, Denmark

[21] Appl. No.: 506,478

[22] Filed: Jul. 25, 1995

Related U.S. Application Data

[63] Continuation-in-part of Ser. No. 202,129, Feb. 25, 1994, abandoned.

[51] Int. Cl.[6] ..... C09K 3/00; C23F 11/04; A61L 2/00

[52] U.S. Cl. ..... 252/392; 252/390; 252/394; 252/396; 422/16; 422/27; 422/23; 510/161

[58] Field of Search ..... 252/392, 390, 252/396, 394; 422/16, 27, 33; 510/161

[56] References Cited

U.S. PATENT DOCUMENTS

| | | | |
|---|---|---|---|
| 2,304,805 | 12/1942 | Denman | 210/23 |
| 2,580,923 | 1/1952 | Jacoby | 252/180 |
| 2,582,138 | 1/1952 | Lane et al. | 252/180 |
| 3,088,796 | 5/1963 | Kahler et al. | 21/2.7 |
| 3,203,904 | 8/1965 | Brown | 252/392 |
| 3,418,254 | 12/1968 | Bishof et al. | 252/392 |
| 3,444,090 | 5/1969 | Michal | 252/312 |
| 3,505,237 | 4/1970 | Steinhauer | 252/180 |
| 3,544,365 | 12/1970 | McCormick | 134/1 |
| 3,687,611 | 8/1972 | Liddell | 21/2.7 |
| 3,931,043 | 1/1976 | Walker et al. | 252/392 |
| 3,993,575 | 11/1976 | Howanitz et al. | 252/142 |
| 4,192,844 | 3/1980 | Trace et al. | 422/11 |
| 4,343,725 | 8/1982 | Kiewert et al. | 252/542 |
| 4,406,811 | 9/1983 | Christensen et al. | 252/180 |
| 4,975,202 | 12/1990 | Fillipo et al. | 210/698 |
| 5,290,472 | 3/1994 | Michael | 252/170 |
| 5,527,468 | 6/1996 | Boyette et al. | 210/698 |

OTHER PUBLICATIONS

"Steam Corrosion and Steam Corrosion Inibition in Autoclave Sterilization of Dental and Surgical Steel Materials", Lars. G. Holmlund, Biotechnology and Bioengineering, vol. VII, pp. 177–198 (1965).

*Primary Examiner*—Shean C. Wu
*Assistant Examiner*—Deanna Baxam
*Attorney, Agent, or Firm*—Oyen Wiggs Green & Mutala

[57] ABSTRACT

A non-toxic solution to be used in the place of distilled or de-ionized water in autoclave sterilizers is disclosed. The solution renders the instruments placed in such sterilizers free of rust, spotting, and hastens the drying time of such instruments.

4 Claims, No Drawings

ANTI-CORROSION, QUICK DRYING DISTILLED WATER SOLUTION FOR AUTOCLAVE STERILIZERS

This application is a continuation-in-part of application Ser. No. 08/202,129, filed Feb. 25, 1994, now abandoned.

FIELD OF THE INVENTION

This invention relates to autoclave sterilizers for medical instruments. More particularly, this invention pertains to a novel anti-corrosion, quick drying distilled water solution for use in such sterilizers.

BACKGROUND OF THE INVENTION

Autoclave sterilizers are widely used for the sterilization of instruments used in the medical, dental and veterinary disciplines. When used under the proper conditions, autoclaves sterilize the instruments by destroying all spores, microorganisms, and viruses present on such instruments. The contents of the autoclave chamber are also sterilized.

Autoclave sterilizers are typically of cabinet size and operate by vapourizing during each use cycle a small amount of purified water to well above boiling temperature. Non-toxic distilled or de-ionized water has traditionally been used in sterilizing autoclaves. Tap water cannot be used because contaminants normally found in tap water, such as minerals, salts, etc. would be introduced and deposited into the instrument sterilization environment and potentially interfere with the sterilization process and the performance of the autoclave sterilizer itself. The autoclave usually holds a reservoir of water, only a small portion of which is used on each occasion. By boiling a small amount of pure water during each cycle, typically less than 100 milliliters, in the closed autoclave chamber, a substantial increase in both temperature and pressure occurs inside the chamber. When the autoclave chamber reaches an appropriate temperature (well above the boiling point of water) and elevated pressure over a minimum period of time, typically 135° C., in about 4 minutes, the contents of the pressurized chamber are rendered sterile. The pressure in the autoclave chamber is then released, purging any remaining water and vapour from the chamber. The sterilized instruments are then allowed to dry prior to their removal from the autoclave.

Autoclave sterilizers are not used for cleaning medical instruments. It is imperative therefore that such instruments be thoroughly mechanically debrided, cleaned and dried prior to their placement in the autoclave for sterilization of the instruments. The preliminary cleaning step removes any materials or deposits that may be contaminating these instruments, prior to sterilization.

The use of sterilizing autoclaves, notwithstanding their benefits, has presented a number of problems and difficulties over the years. Distilled or de-ionized water must be used in the autoclave to prevent impurities and deposits typically found in tap water from contaminating the sterilization apparatus and procedure. A major longstanding problem associated with sterilizing autoclaves, and the use of distilled water, and one which has not been solved to date, is that precision carbon steel instruments corrode during the autoclaving and subsequent extended drying process due to the formation of carbonic acid. Corrosive carbonic acid, formed from the carbon dioxide present in air and the water molecules in the vapourized water, and its condensate, acts upon surgical carbon steel and results in the formation of ferrous oxide, and other breakdown mineral products, or corrosion, on such carbon steel instruments.

Conventional autoclave sterilization of medical, dental and veterinary instruments, especially those made of carbon steel, produces corrosion, rusting and dulling of the sensitive cutting surfaces of the instruments. The long drying time required for autoclaved instruments increases exposure of the instruments to water vapour and its condensate and further promotes the corrosion process. This prolonged drying time delays the return of those instruments to the instrument "pool" for re-use.

A number of patents relate to rust inhibitors, surfactants and steam creating vessels in general. These are listed below.

| U.S. Pat. No. | Inventor | Issue Date |
|---|---|---|
| 2,580,923 | Jacoby | January 1, 1952 |
| 2,582,138 | Lane | January 8, 1952 |
| 3,088,796 | Kahler | May 7, 1963 |
| 3,505,237 | Steinhauer | April 7, 1970 |
| 3,687,611 | Liddell | August 29, 1972 |
| 3,993,575 | Howanitz et al. | November 23, 1976 |
| 4,192,844 | Trace | March 11, 1980 |
| 4,975,202 | Fillipo | December 4, 1990 |
| 5,290,472 | Michael | March 1, 1994 |

Jacoby discloses amine compositions and a method of treating the water used in steam generation systems. This has nothing to do with non-toxic chemicals or sterilization of medical instruments. One of the compositions disclosed includes cyclohexylamine (see Example III). None of the compositions contain polyoxyethylene polymers. The compositions are in the form of briquettes containing solid salts of cyclohexylamine or other amines. The briquettes can be easily handled, and placed in the water feed lines of the steam system to be hydrolysed by the water as it enters the system.

Lane discloses a number of cyclohexylamine-containing compositions for inhibiting corrosion in steam systems. Lane is not concerned with toxicity. Lane purports to deal with the problem of incomplete corrosion protection throughout the system. The problem results from the fact that when using certain amines for corrosion inhibition, only certain sections of the condensate system will be protected. The compositions disclosed are mixtures of amines, one of which is cyclohexylamine, which solve the above problem by having the different amines distribute themselves though the system. This patent has no relevance to the sterilization of medical instruments.

Liddell discloses the use of cyclohexylamine-containing compositions to inhibit corrosion of mild steel in systems where wood is steamed in order to remove treatment compounds from the wood. Such chemicals can be toxic. The invention is directed at the problem of corrosion of the metal treating cylinder, which causes an undesirable discoloration of the wood during the process of the steam cycle. Cyclohexylamine is one of the compounds claimed to be effective in this process.

Trace discloses the use of cyclohexylamine-containing corrosion inhibitor compositions. Trace's invention is directed at solving the problem of loss of amine-based corrosion inhibitors due to aeration and venting in steam generation systems. This problem occurs with cyclohexylamine and some other amines, but apparently not with the amines in the compositions and methods covered by Trace, which include methoxypropylamine. Trace is not concerned with sterilizing autoclaves or toxicity.

Kahler discloses the use of a primary aliphatic amine and a polyoxyethylene polymer in various compositions in order to give a composition with a good product quality, and increased stability to the amine-based corrosion inhibiting compound. This patent does not pertain to sterilizing autoclaves.

Steinbauer discloses the use of a polyethylene glycol and a polyoxyethylene-based polymer as an emulsifier in a steam iron additive. Toxicity is not a factor. The invention utilizes a siloxane-polyoxyethylene block copolymer and is directed at overcoming problems associated with the use of steam irons or a "steam promoting apparatus". The siloxane-polyoxyethylene block copolymer is added to the composition in order to impart good lubrication and anti-wear properties, and to enhance steam formation by inhibiting bubble formation. No reference to sterilizing autoclaves is made.

Howanitz et al. disclose a potentially toxic acid cleaning composition for use in cleaning railroad rolling stock and other heavy equipment. The major ingredient is oxalic acid (10%). Howanitz et al. use an aliphatic amine, monoethanolamine, to partially neutralize the acid and to increase its solubility. Howanitz et al. do not teach an alicyclic amine such as cyclohexylamine, for use as a corrosion inhibitor in a sterilizing autoclave. Howanitz et al. do not disclose a non-toxic composition comprising distilled water, an anti-corrosion agent and a quick drying agent, for use with pre-cleaned medical instruments in an autoclave sterilizer at a specific temperature and pressure range. Rather an oxalic acid and thickener composition, which could be toxic, that is sprayed onto heavy rolling stock to clean the surface of it, at any temperature, without harm to coated polycarbonate glass substitute is disclosed. Howanitz et al. do not disclose cyclohexylamine or polyoxypropylene-polyoxyethylene block co-polymer or distilled water.

Michael discloses a hard surface (floor) cleaning composition comprising a nonionic detergent surfactant and a glycol hydrophobic solvent and, optionally, a fatty acid together with an anionic detergent surfactant, an alkanolamine, or other various adjuvants. This composition is intended for cleaning vinyl flooring, not intended for use in a sterilizing autoclave, and in many combinations would be toxic. Michael does not disclose a non-toxic concentration of an alicyclic amine anti-corrosion agent and block co-polymer surfactant, and suggests alkanolamines to act as alkaline buffers to improve filming properties of hard surface cleaners. Michael does not disclose that the water used in his composition should be distilled water that has been treated to remove impurities, or a temperature and pressure range for its use. There is no notion of sterilization.

Fillipo discloses a method for increasing the temperature induced and/or salt concentration induced cloud point of a surfactant-containing boiler water treatment solution which is added to ordinary water used in a boiler. The concept of non-toxicity and distilled water are not pertinent. The Fillipo solution helps to control the buildup on boiler system heating elements of impurities originating from the local water supply. The use of distilled water is not possible because of the large quantities of water that must be used. These impurities in the ordinary water can be calcium and magnesium salts, carbonate salts, sulfites, phosphates, siliceous material, and iron oxides, and any number of other impurities. As the large volumes of regular water are continually boiled, these impurities inherent in the untreated water supply will deposit and precipitate on the heating surfaces of the boiler, thus decreasing its heating efficiency.

Fillipo describes how certain types of surfactants, the polymeric dispersants which contain phenolic ether, have been incorporated in boiler feed water to help reduce deposits originating from the feed water from precipitating on the boiler's heating surfaces. At certain temperatures and concentrations of this surfactant in the feed water, the cloud point is reached, preventing any more surfactant from dissolving in the feed water. Thus, not only impurities from the feed water, but also excess surfactant could precipitate on boiler heating surfaces.

Fillipo teaches the addition of a combination of cyclohexylamine and diethylaminoethanol as well as other toxic ingredients such as caustic soda to the surfactant containing boiler feed water. When such lower alkyl amines or strong acids are added to the phenolic ether type-surfactant in the solution, the dehydration of ether linkages in the surfactant is lessened, thus the cloud point of the feed water solution increases, which allows for more surfactant to dissolve in the water, and less surfactant to precipitate onto the boiler's heating surfaces.

Fillipo describes a method to increase the stability of a phenolic ether type surfactant typically used to limit the precipitation of vast quantities of impurities inherent in raw boiler feed water by adding toxic quantities of lower alkyl amines, substituted amines, strong acids and caustic soda to increase the cloud point of the surfactant/feed water solution.

All of this is completely irrelevant to sterilizing autoclaves where toxicity is an important factor. Specifically, Fillipo does not teach the use of distilled water, which contains no impurities, for use as boiler feed water. Indeed, the thought of using distilled water is completely impractical. If distilled water, which is expensive in vast quantities, was used, there would be no substantial need for surfactants in boiler feed water as there would be no precipitating impurities to combat, and thus no need for toxic adjuvants to increase cloud point to help limit the precipitation of such impurities. Fillipo is focused on a completely different field of technology and does not teach the use of a minute non-toxic concentration of cyclohexylamine in distilled water to prevent the formation of carbonic acid on delicate, previously cleaned and debrided carbon steel medical instruments. He is not concerned with the subsequent formation of ferrous oxide corrosion on these instruments which occurs during the autoclaving sterilization process. Fillipo does not teach the use of a straight chain block copolymer surfactant which does not contain phenolic ether which can degrade, in a minute, non-toxic concentration in the cyclohexylamine/distilled water solution to promote quick drying of the sterilized instruments to further lessen the chance of corrosion and to allow the instruments to be quickly returned to use. Fillipo does not disclose the effectiveness of this non-toxic cyclohexylamine/surfactant/distilled water solution at temperatures of up to 135° C. and pressures of up to 210 kiloPascals.

Although sterilizing autoclaves with minute amounts of non-toxic distilled water have been used for many years to sterilize previously cleaned medical instruments, and the autoclaves have served this purpose, everyone using such autoclaves has had to put up with the problems of instrument spotting, slow drying and corrosion. Complaints have been made for years but no one has endeavoured to seek a non-toxic solution to these problems.

SUMMARY OF THE INVENTION

The purpose of this invention is to overcome the spotting, corrosion and slow drying drawbacks and difficulties normally encountered in the use of autoclave sterilizers. By solving these problems, the invention increases the acceptability and versatility of autoclaves for use in the medical instrument sterilization process, while at the same time providing a safe non-toxic environment for such instruments.

The present invention relates to a novel non-toxic, liquid, solution suitable for use in autoclave sterilizers, The solution comprises distilled water, a small non-toxic amount of a corrosion inhibitor and a small amount of a quick-dry promoting non-toxic surfactant. The solution does not break down at elevated temperatures and pressures. When this solution is used in place of the distilled or de-ionized water that is normally used in autoclaves, the instruments sterilized in such autoclaves are free of rust corrosion and water spots. The solution also promotes quick drying of such instruments after the sterilization process. By being non-toxic, this invention is user friendly and environmentally safe. It is also easy and trouble-free for use by persons experienced with autoclave sterilizers.

The invention is directed to a non-toxic liquid composition for autoclaves used for sterilization and quick drying of previously cleaned medical instruments consisting essentially of: (a) about 0.01% to about 1.0% volume of an anti-corrosion agent comprising a non-toxic concentration of alicyclic amine soluble in water of a temperature range from about 0° C. to about 150° C.; (b) about 0.01% to about 1.0% volume of an anti-spotting quick-drying agent comprising a non-toxic concentration of block co-polymer surfactant soluble in water of a temperature range from about 0° C. to about 150° C.; and (c) the remainder comprising distilled water; said liquid composition when used in an autoclave within the specified temperature range preventing corrosion and spotting and promoting quick drying of prior cleaned medical instruments sterilized in said autoclave.

The temperature range can be from about 20° C. to 135° C. The anti-corrosion agent can be cyclohexylamine. The anti-spotting quick-drying agent can be polyoxypropylene-polyoxyethylene block co-polymer or polyoxypropylene-polyoxyethylene block co-polymer.

The invention is also directed to a non-toxic liquid composition for autoclaves used for sterilizing and quick drying of previously cleaned medical instruments consisting essentially of: (a) about 0.05% to about 0.15% volume of alicyclic amine anti-corrosion agent which is soluble in water and does not degrade between a temperature range of about 20° C. to about 150° C.; (b) about 0.05% to about 0.15% volume of block co-polymer anti-spotting quick-drying surfactant which is soluble in water and does not degrade between a temperature range of about 5° C. to about 150° C.; and (c) about 99.7% to about 99.9% volume of purified water treated to remove dissolved minerals and impurities; said liquid composition when used in a sterilizing autoclave within the specified temperature range preventing corrosion and spotting and promoting quick drying of prior cleaned medical instruments sterilized in said autoclave.

The alicyclic amine can be cyclohexylamine at a concentration of about 0.1% volume and the block co-polymer surfactant can be polyoxypropylene-polyoxyethylene block co-polymer at a concentration of about 0.1% volume, the temperature range can be from about 20° C. to about 135° C., and the purified water can be distilled water of about 99.8% volume.

The composition in a specific embodiment can comprise over 99.8% distilled water, and equal parts of cyclohexylamine as a corrosion inhibitor and Pluronic 25R2 (BASF Corporation, Parsippany, N.J.) as a quick dry surfactant.

DETAILED DESCRIPTION OF SPECIFIC EMBODIMENTS OF THE INVENTION

A conventional autoclave sterilization process involves the use of a small amount of pure distilled water to produce a small amount of water vapour, under pressure, to attain in a closed autoclave chamber, fixed temperatures of up to 150° C., preferably 135° C., and elevated pressure, for a period of no less than 3 minutes, and preferably 4 minutes. This high temperature, pressure and time period kills all types of living organisms in the autoclave chamber, or present on previously cleaned medical instruments placed in the chamber. Distilled or de-ionized water must be used so as not to introduce mineral and salt impurities typically found in a conventional water supply that would precipitate out during the sterilization process, thus fouling the autoclave and its contents rendered for sterilization. Instruments placed in such a system must be pre-cleaned and debrided prior to their placement in the autoclave. A common, longstanding problem with instruments, especially those made of surgical carbon steel, which is a commonly used metal in such cases, is by being subjected to steam sterilization and a prolonged drying period, they display over time various levels of corrosion that interfere with the precision function of the medical instruments. The unsightly water marks tend to imply that the instruments are not cleaned or sterilized, even though this is not so.

Organic amines have been shown to inhibit rust and corrosion in open water/steam systems. Some are toxic and unsuitable for use in the medical field. The particular type of organic amine and its concentration used within these open systems has met with varying degrees of success as a rust inhibitor. This is due in part to the open nature of the system in which the organic amine is used.

The use of the broad group of chemicals known as surfactants, and particularly non-ionic surfactants, as rinse and drying agents is widely accepted in consumer and industrial applications. Such surfactants are typically used at below boiling temperatures of 100° C. and at atmospheric pressure. Many such surfactants are toxic, or at least unsuitable for use in medical instrument sterilization applications.

I have discovered that a combination of a non-toxic rust/corrosion inhibitor and a non-toxic quick dry promoting surfactant, dissolved in small specified quantities in pure distilled water or de-ionized water provides a superior sterilizer solution which yields corrosion-free, spot-free, quick-drying medical instruments. This new composition replaces distilled or de-ionized water which is now used in sterilizing autoclaves. The composition of the invention meets the requirements of non-toxicity, chemical compatibility, solubility, and stability under high temperature and pressure, typical in a sterilizing autoclave. The solution also remains stable, that is, it does not decompose into non-toxic or even more importantly, toxic components, after re-condensation, which is a fundamental requirement in an autoclave. The corrosion inhibitor and surfactant are used in minute concentrations so that the solution is non-toxic to the user and the environment. The solution of the invention does not impact negatively upon the autoclave in terms of the actual sterilization process per se and the aftermath of such a process. Both the autoclave itself, and the prior cleaned instruments placed in it for sterilization, are clean, sterile and safe to use. In effect, the purpose of this invention is to create a novel solution which behaves as much as possible as virtually pure water when used in an autoclave, but at the same time overcomes the corrosion, spotting and slow-drying difficulties associated with the use of pure water in sterilizing autoclaves, and furthermore, enhances the function and utility of the autoclave.

EXAMPLES

Through a long process of trial and error, using predominantly the "Validator 8"™ (Pelton and Crane, Charlotte, N.C., U.S.A.), "Aquaclave 20"™ (MDT Corporation, Gardena, Calif. U.S.A.) and "Statim"™ (Sci-Can, Toronto, Ont.) autoclaves, and meeting with many failures, I have discovered a solution of over 99.8% distilled water with equal parts (each less than 0.1% of the total solution) of an acyclic amine, acting as a corrosion inhibitor, and a polyoxypropylene-polyoxyethylene block copolymer surfactant, acting as an anti-spotting, quick-drying agent, produces very favourable results in sterilizing. medical instruments. The results were consistent in over 2,000 clinical trials in the sterilization of medical instruments in autoclaves, with no spotting or corrosion. Drying rates were enhanced. The solution did not break down even though subjected to high temperatures and pressure, for prolonged periods of time.

Example 1

At the outset, to set a baseline parameter for comparative purposes, a variety of dental instruments, made of various materials such as stainless steel, carbon steel, plastics, were hand scrubbed under running water, placed in an ultrasonic bath for ten minutes, rinsed under water again and then placed either bagged in a standard paper sterilization pouch or placed directly into an autoclave, which had distilled water incorporated in it.

Following a sterilization cycle of either 3 minutes at 133° C. or 12 minutes at 133° C., at an elevated pressure, and a subsequent short depressurization phase, the instruments were removed and inspected.

It was found in general that all unbagged instruments were wet and that the paper bags were water saturated. They continued to be so for a period of up to 10 minutes. The carbon steel instruments demonstrated various levels of oxidation, corrosion and rusting, especially along their cutting surfaces. These instruments, when dry, tended to exhibit spotting, most noticeably on reflective surfaces (i.e. mirrors). After repeated sterilization cycles, the trays and walls of the autoclave chamber displayed water spotting and corrosion deposits.

These findings are typical of what is usually the case with autoclave sterilizers. As well, throughout this period, intermittent spore tests were carried out to verify a positive sterilization process. Spore tests were randomly conducted using control and test strips of paper inoculated with spores from two species, *Bacillus stearothermophilus* and *Bacillus subtilis*. The spore tests as conducted confirmed that sterilization was achieved.

Example 2

The autoclave reservoirs of Example 1 were then totally drained, and an amount of invention comprising 0.1% volume cyclohexylamine, 0.1% volume Pluronic 25R2 and 99.8% volume distilled water appropriate to the autoclave was added. Generally, less than 100 ml of solution was used in each case.

When the solution of the invention was used in place of pure water in the autoclave, it was found that:

1) Instruments, including those of carbon steel, when sterilized according to the autoclave manufacturers' directions, did not upon clinical examination exhibit corrosion.
2) Instruments, including those with reflective surfaces (eg. dental mirrors) did not exhibit any spots or water marks. They were sparkling clean.
3) Instruments, upon removal from the autoclave at the completion of the sterilization cycle, dried almost immediately.
4) Paper sterilization pouches containing instruments were initially saturated with moisture, but dried at a much faster rate than had been observed using distilled water alone. This helped to maintain the integrity of the bag itself. The bag did not seem to fall apart as easily after sterilization as those that were sterilized using distilled water.
5) Deposits and coating debris build-up, which is typically found in multiple use autoclave chambers, and trays contained therein, when conventional distilled water is used, did not manifest when the solution of the invention was used.
6) The positive effects of the solution of the invention upon the instruments did not diminish through the life of the solution in the autoclave.

It is typical of autoclaves to have a condensation phase wherein, following the sterilization cycle, some of the water vapour is condensed and then re-used in the sterilization process. In, for example, the "Validator 8", one can reasonably expect one Imperial gallon or 1.32 U.S. gallons (5 liters) of pure water to last up to 50 sterilization cycles before a low water level indicator on the autoclave signals that more water is required. When one Imp. gallon of the solution of the invention was used in place of pure water, it also lasted up to 50 cycles, with no noticeable deterioration of the quality of above-mentioned positive results of the invention. No breakdown products were noted.

Spore tests randomly conducted on the sterilization process using the solution of the invention confirmed that sterilization had been achieved.

During the clinical testing of the solution of the invention, the oxidation and corrosion of carbon steel instruments occurred in only two instances. The first instance occurred when the carbon steel instruments were placed wet into the autoclave chamber, but the autoclave was not activated for a period of fifteen hours after the instruments had been placed in the autoclave. When the instruments were removed, corrosion had occurred. This was to be expected. The instruments were immediately cleaned and placed wet into the autoclave, and immediately sterilized and inspected. No corrosion was evident. The corrosion that had previously been seen had likely occurred during the 15 hour delay when the wet instruments remained in the autoclave before it was activated.

The second incidence of corrosion occurred during a blind test conducted by the inventor. Unbeknownst to the licensed technical staff who had been operating the sterilizers, the inventor had totally drained the solution of the invention from one of the sterilizers and refilled it with pure distilled water. The technical staff immediately noticed the corrosion and reported it to the inventor. The instruments were cleaned and re-sterilized after the autoclave was drained and filled with the solution of the invention. No subsequent rusting occurred.

At the end of the sterilization cycle, autoclaves go through a depressurization phase, where hot water vapour is vented from the autoclave into the air. Hot water vapour from the autoclave also escapes into the air when the autoclave door is opened after the sterilization process is completed. Since cyclohexylamine at certain concentrations is a regulated material in many jurisdictions, a worker exposure assessment to cyclohexylamine during autoclave operation was conducted. An independent consultant in occupational hygiene, safety management and hazardous product control collected and analyzed air samples from the immediate area of operation of the autoclave. It was shown that the use of the solution of the invention in the autoclave did not adversely expose workers to objectionable levels of the cyclohexylamine.

In the study, a pump was used to collect and draw air over an activated carbon collection tube. The sample was analyzed according to NIOSH method 2010 using gas chromatography. The air volume collected was 23.18 liters. The sampling was done while the autoclave sterilizer went through 10 operational cycles, over an 8 hour period. This would be typical of autoclave operation within the clinical setting.

An acceptable maximum concentration of cyclohexylamine in the air for an 8 hour period is 40 milligrams per cubic meter. Test results showed less than 0.4 milligram per cubic meter, and less than 0.09 parts per million of cyclohexylamine, which is well under safety thresholds.

The non-toxicity of the solution of the invention to workers and environment is paramount to its acceptability.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A non-toxic liquid composition for autoclaves used for sterilizing and quick drying of previously cleaned medical instruments consisting essentially of:

(a) about 0.05% to about 0.15% volume of a non-filming alicyclic amine anti-corrosion agent which is soluble in water and does not degrade between a temperature range of about 20° C. to about 150° C.;

(b) about 0.05% to about 0.15% volume of block co-polymer anti-spotting quick-drying surfactant which is soluble in water and does not degrade between a temperature range of about 5° C. to about 150° C.; and (c) about 99.7% to about 99.9% volume of purified water treated to remove dissolved minerals and impurities;

said liquid composition when used in a sterilizing autoclave within a temperature range of 20° C. to 135° C. preventing corrosion and spotting and promoting quick drying of prior cleaned medical instruments sterilized in said autoclave.

2. A composition as claimed in claim 1 wherein the alicyclic amine is cyclohexylamine at a concentration of about 0.1% volume and the block co-polymer surfactant is polyoxypropylene-polyoxyethylene block co-polymer at a concentration of about 0.1% volume, and the purified water is distilled water of about 99.8% volume.

3. A non-toxic liquid composition for autoclaves used for sterilization and quick drying of previously cleaned medical instruments consisting essentially of:

(a) about 0.05% to about 0.15% volume of an anti-corrosion agent consisting essentially of a non-toxic concentration of alicyclic amine which is soluble in water and does not degrade between a temperature range from about 0° C. to about 150° C.;

(b) about 0.05% to about 0.15% volume of an anti-spotting quick-drying agent consisting essentially of a non-toxic concentration of polyoxypropylene-polyoxyethylene block co-polymer surfactant which is soluble in water and does not degrade between a temperature range from about 0° C. to about 150° C.; and (c) the remainder consisting essentially of distilled water; said liquid composition when used in an autoclave within the specified temperature range preventing corrosion and spotting and promoting quick-drying of prior cleaned medical instruments sterilized in said autoclave.

4. A composition as claimed in claim 3 wherein the anti-corrosion agent is cyclohexylamine.

* * * * *